US006214065B1

(12) United States Patent
Berg

(10) Patent No.: US 6,214,065 B1
(45) Date of Patent: Apr. 10, 2001

(54) METHOD OF OPERATING A FLUIDIZED BED REACTOR SYSTEM, AND FLUIDIZED BED REACTOR SYSTEM

(75) Inventor: Eero Berg, Varkaus (FI)

(73) Assignee: Foster Wheeler Energia Oy, Helsinki (FI)

( * ) Notice: Subject to any disclaimer, the term of this patent is extended or adjusted under 35 U.S.C. 154(b) by 0 days.

(21) Appl. No.: 09/117,141

(22) PCT Filed: Feb. 21, 1996

(86) PCT No.: PCT/FI96/00100

§ 371 Date: Jul. 24, 1998

§ 102(e) Date: Jul. 24, 1998

(87) PCT Pub. No.: WO97/31084

PCT Pub. Date: Aug. 28, 1997

(51) Int. Cl.[7] ..... C10J 3/54; F27B 15/09

(52) U.S. Cl. ..... 48/197 R; 422/145; 422/147

(58) Field of Search ..... 48/197 R, 210; 201/3, 4, 31, 35; 202/197; 422/145, 147; 122/4 D, 2, 379

(56) References Cited

U.S. PATENT DOCUMENTS

| | | | | |
|---|---|---|---|---|
| 4,412,848 | | 11/1983 | Koyama et al. | 48/197 R |
| 4,936,872 | * | 6/1990 | Brandl et al. | 48/197 R |
| 5,269,263 | * | 12/1993 | Garcia-Mallol | 122/4 D |
| 5,281,398 | | 1/1994 | Hyppanen et al. | 422/147 |
| 5,658,359 | * | 8/1997 | Berg et al. | 48/197 R |

FOREIGN PATENT DOCUMENTS 2 232 682 12/1990 (GB) .

* cited by examiner

*Primary Examiner*—Shrive Beck
*Assistant Examiner*—Frederick Varcoe
(74) *Attorney, Agent, or Firm*—Fitzpatrick, Cella, Harper & Scinto

(57) ABSTRACT

A method of operating a fluidized bed reactor system for reacting fuel. The method includes introducing solid material particles, fluidization medium and fuel into a reactor chamber to provide a fluidized bed therewithin, reacting the fuel material within the fluidized bed to produce exhaust gas and discharging the exhaust gas from a reactor chamber outlet, introducing the exhaust gas into a particle separator and separating solid particles from the gas in the particle separator, discharging from the particle separator gas through a gas outlet and a first flow of separated solid particles through a solid particle outlet, and cooling, in a gas cooler, the gas discharged from the separator. A second flow of solid particles is branched off from the first flow of solid particles, before or after discharging the first flow of solid particles from the particle separator. The second flow of solid particles is introduced into the gas discharge from the separator at least before the cooling step, so that the solid particles mechanically dislodge deposits from, and thereby clean, the cooling surfaces in the gas cooler.

21 Claims, 3 Drawing Sheets

METHOD OF OPERATING A FLUIDIZED BED REACTOR SYSTEM, AND FLUIDIZED BED REACTOR SYSTEM

The present invention refers to a method and system of operating a fluidized bed reactor system.

Fluidized bed reactors, particularly circulating fluidized bed (CFB) reactors, are extremely useful in practicing a wide variety of reactions, such as combustion and gasification of fuel material, in atmospheric or pressurized conditions. Gasification in a fluidized bed reactor is an attractive way to convert energy of fuel material into a more useful form, producing combustible gas. Combustion of fuel in a fluidized bed reactor may produce steam to drive a steam turbine. However, under many circumstances, the gas discharged from the reactor (e.g., fuel product gas) may contain undesirable substances such as extremely fine dust and tar-like condensable compounds. These substances tend to turn sticky especially below certain temperatures, and therefore deposit or accumulate on surrounding surfaces, in particular surfaces of gas cooling devices, having an adverse effect on the surfaces and heat transfer.

When the hot gas coming from the gasification/combustion reactor is introduced into a gas, the cooler above mentioned undesirable substances easily block the inlet of the gas cooler or heat transfer surfaces disposed therein. Especially, very fine carbon (soot), fine ash particles, alkali fumes, alkali oxides or liquid compounds tend to form deposits in the gas cooler.

In the gasification processes, the gas has to be cleaned before further use. The carbon particles (soot) contained in the gas is very fine, has typically a grain size of 0.1–5 $\mu$m, and is sticky. Such sticky fine material is difficult to separate by filtration. The gas can be filtrated by adding into the gas coarser non-sticky particles, having a grain size distribution of –200 $\mu$m. Those particles together with fine soot are able to form a filter cake on filter elements. Filtration properties will be further improved if the added particles are porous.

The problem of fouling of gas cooling surfaces has been addressed by using a direct heat transfer system, such as suggested in U.S. Pat. Nos. 4,412,848 and 4,936,872. In these patents, product gas is led into fluidized bed gas coolers, and the fouling components are captured by particles of the fluidized bed.

The use of a separate fluidized bed, as described above, is hardly an ideal solution to the problem, however, since the additional bed consumes space and requires construction and maintenance of different components, which can make costs prohibitive. Using indirect recuperator heat exchangers has also been found to be unacceptable, however, due to exhaust fouling difficulties.

The fouling problem described above is particularly acute under pressurized conditions, e.g., superatmospheric pressure of about 2–50 bars. Under such pressurized conditions, conventional steam soot blowers do not work properly.

The problems as indicated above do not exist solely during gasification, but also during combustion of a number of different types of fuel in a fluidized bed. For example, when brown coal is burned, the flue gases contain alkali species which condense on cooling surfaces, accumulating on the surfaces, fouling them, and causing corrosion of surrounding surfaces. Difficulties also occur particularly in the combustion of municipal waste or sludge.

It is, therefore, the primary object of the present invention to provide a method and system which minimize the problem of gas particles depositing on gas cooling surfaces.

It is also the object of the present invention to provide a method and system which minimize the fouling and corroding of cooling surfaces.

It is further the object of the present invention to provide a method and system which improve heat transfer from gas containing very fine particles or tar-like condensable compounds.

The above mentioned objects are achieved in accordance with the present invention by a method and system including the features recited in the pending claims.

The basic concept behind the invention thereby is to utilize the very same solids which are used as bed material (e.g., inert bed material such as sand and/or reactive bed material such as limestone) in fluidized bed reactors to mechanically scrub the gas cooler's cooling surfaces so as to prevent accumulation of deposits thereon, and or to remove deposits therefrom.

It has earlier been suggested in applicant's co-pending patent application PCT/FI95/00438 that bed material is introduced from a separate bed material supply source into the gas cooler for cleaning the cooling surfaces. Alternatively, in circulating fluidized bed reactors where the main part of the solid bed material is separated from gases exhausted from the reactor chamber in a separator (e.g., a cyclone separator or similar device) before introducing the thus cleaned gas into the gas cooler, it was suggested to periodically decrease the efficiency of the separator (cyclone) and allow non-separated particles to flow with the gas into the gas cooler.

The present invention also solves the above mentioned problems of particles depositing on gas cooling surfaces, and it does so in a very simple and easily controllable manner. The present invention provides an alternative method to supply easily controlled amounts of bed particles, without the need to transport the particles from distant supplies.

The present invention is also applicable to all types of fluidized bed reactors and reactor systems, and is particularly applicable to circulating fluidized bed reactors, and to pressurized systems (that is, operating at a pressure of about 2–50 bar, preferably, 2–30 bar).

According to one aspect of the present invention, a method of operating a fluidized bed reactor system for reacting fuel is provided, said reactor system comprising:

- a fluidized bed reactor chamber having a reactor chamber outlet for gas produced during fuel reaction (combustion, gasification, etc.)
- a particle separator, such as a cyclone separator, connected to the reactor chamber outlet for separating solid material from gas exhausted from the reactor chamber, said particle separator having a solid particle outlet and a gas outlet, and
- a gas cooler having cooling surfaces (heat transfer surfaces) and being connected to the gas outlet of the particle separator.

The method comprises the steps of:

(a) introducing solid material particles, fluidization medium and fuel into the reactor chamber to provide a fluidized bed therewithin;

(b) reacting the fuel material within the fluidized bed to produce exhaust gas and discharging the exhaust gas from the reactor chamber outlet;

(c) introducing the exhaust gas into the particle separator and separating solid particles from the gas in said particle separator;

(d) discharging from the separator a first flow of separated solid particles through the solid particle outlet and gas through the gas outlet and (e) cooling the gas discharged from the separator in the gas cooler.

The method is characterized by the additional steps of:

(f) branching off from the first flow of solid particles, before or after discharging said first flow of solid particles from the particle separator, a second flow of solid particles;

(g) introducing said second flow of particles into the gas discharged from the separator during, or before step (e), so that the particles mechanically dislodge deposits from, and thereby clean, the cooling surfaces, and (h) removing the particles from the gas after step (g).

Step (f) is practiced to provide a sufficient concentration and size of separated solid particles into the gas for cleaning the cooling surfaces or keeping the cooling surfaces clean.

Steps (f) to (g) are preferably practiced only at spaced intervals (e.g., intermittently or periodically, or in response to sensing of a decrease in cooling efficiency), but may be practiced continuously. Step (g) is typically practiced by introducing particles separated in step (c) into the gas just before the gas cooler.

Typically, step (b) is practiced to produce gas at a temperature above 600° C. and step (e) is practiced to cool the gas to about 400° C.

According to another aspect of the present invention a circulating fluidized bed reactor system is provided, comprising the following elements:

a fluidized bed reactor chamber having a bed material inlet, an exhaust gas outlet and a fluidizing gas inlet;

a cyclone separator connected to the exhaust gas outlet, said separator having a gas outlet and a particle outlet for returning separated solid bed material to the reactor chamber;

a return conduit connecting the particle outlet of the separator to the reactor chamber;

a gas cooler connected to the separator gas outlet, the gas cooler having cooling surfaces and means for branching off a flow of solid bed material from the separated solid bed material and introducing said branched off flow of bed material into the gas cooler.

The means for branching off a flow of bed material and introducing it into the gas cooler typically comprises an opening in the bottom of the separator and a by-pass conduit connecting said opening with the gas cooler or the inlet thereto. The means comprises according to another typical embodiment a branch conduit connecting the return conduit with the gas cooler or the inlet thereto.

According to the present invention, in a circulating fluidized bed reactor, the gas cooler may be kept clean by means of a portion of the circulating bed material itself. The main portion of the circulating bed material is typically returned from the separator (e.g., cyclone separator) to the dense bed in the reactor chamber, whereas a typically minor portion of the circulating bed material is branched off the main portion and introduced into the gas cooler for cleaning the cooling surfaces therein. A gas flow may be utilized to transport the minor portion of bed material to the gas cooler.

The solids needed for cleaning of the gas cooler are typically gathered from the bottom of the particle separator, but can alternatively be gathered from the wall of the particle separator or from the return conduit. The particles gathered in a cyclone separator are led through a separate conduit into the gas cooler. In embodiments where gas is discharged from the cyclone through a center pipe in the bottom thereof, the separate particle conduit by-passes the gas center pipe of the cyclone. A gas flow may be introduced into this by-pass conduit in order to help to carry the particles and prevent blocking of the by-pass conduit.

The mass flow of solids flowing to the gas cooler can be controlled e.g., by means of a plate which can be placed to cover wholly or partly the inlet opening into the by-pass conduit. The position of the cover plate may be controlled and operated outside the cyclone enclosure so that the plate opens or closes the inlet into the by-pass conduit for introducing sufficient amounts of particles to clean the cooling surfaces.

The system preferably further comprises one common or two or more separate pressure vessels for surrounding the reactor, separator and cooler for maintaining them at superatmospheric pressure (e.g., 2–50 bar). A second separator is preferably provided downstream of the gas cooler for separating bed particles from gas discharged from the cooler.

It is the primary object of the present invention to avoid the problem of gas cooler surface fouling in fluidized bed reactor systems in a simple yet effective manner. This and other objects of the invention will become clear from an inspection of the detailed description of the invention and from the appended claims.

DETAILED DESCRIPTION OF THE DRAWINGS

Figure 1:
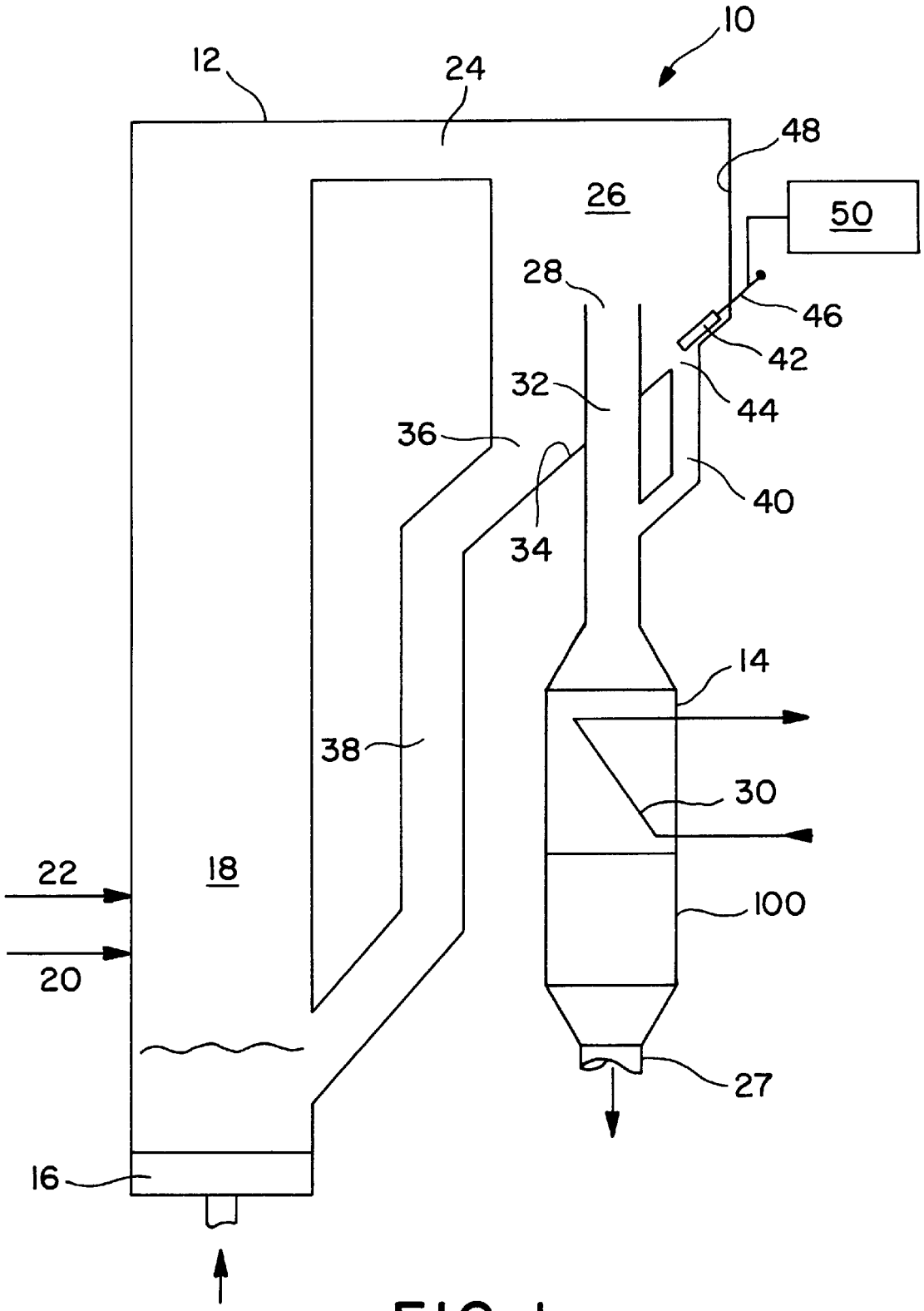
FIG. 1 is a schematic view of the first exemplary embodiment of a circulating fluidized bed reactor system according to the present invention.

FIG. 1 illustrates a circulating fluidized bed (CFB) gasification reactor system 10 according to the present invention, including a circulating fluidized bed reactor 12 and a gas cooler 14. Gasification is performed in the reactor 12 by introducing fluidizing gas through plenum 16 at the bottom of the reactor chamber 18. Solid fuel material is introduced into the reactor chamber 18 via an inlet 20 and solid bed material is introduced via inlet 22. The solid bed material may be an inert material such as sand, and may comprise additives, such as material active in the gasification process, e.g., limestone or other sulfur oxide reducing agents.

The fuel material introduced at 20 is reacted (gasified in the case of FIG. 1, but combusted or otherwise reacted in other reactor systems which also are within the scope of the invention) to produce an exhaust gas which is discharged from an outlet 24 adjacent the top of the reactor chamber 18 and connected to a cyclone separator 26.

In the FIG. 1 embodiment, the cyclone separator 26 comprises a gas outlet 28 forming the inlet end of a gas discharge conduit 32 arranged to go through the bottom 34 of the separator 26. The gas discharge conduit 32 protrudes into the cyclone separator 26, so as to place the gas outlet at a distance above the bottom 34 and so as to form a center piece within the vortex chamber of the cyclone separator 26. Hot gas is introduced through reactor outlet 24 into the cyclone separator 26 so as to form a vortex flow therein, whereby solid particles are separated and gather on the bottom 34. Being inclined, the bottom 34 of the cyclone separator 26 causes the separated solid material to flow downwards towards a solid material outlet 36, disposed in the lowermost part of the bottom 34. The solid material outlet 36 is connected through a solid material return conduit 38 with the bottom region of the reactor chamber 18, for recycling separated solid material into the reactor chamber 18.

The gas produced during the reaction in reactor chamber 18 and discharged through reactor outlet 24 includes in it entrained particulates, such as inert solid bed particles, additives and un-reacted fuel material, including some fine carbon material. The vast majority of the particles, particularly the large particles, are separated from the exhaust gas by the separator 26, and are returned by return conduit 38 to the lower part of the reactor chamber 18, as is conventional per se.

The product gas which exhausts the separator 26 passes to the gas cooler 14. Typically, the exhaust gas from the reactor chamber 18 and separator 26 has a temperature above 600° C., and the cooler 14 is typically designed to cool the gases to about 400° C. In the FIG. 1 embodiment, the gas cooler 14 includes a heat exchanger 30 formed of heat transfer surfaces, hot gas flowing on the outside of the heat transfer surfaces. The heat transfer surfaces may be made of water tubes, typically for producing steam to drive a steam turbine. Another heat exchanger or more may, if desired, be provided, connected to a turbine, other heat exchangers or the like.

Instead of a cooler 14 as shown in FIG. 1, a fire-tube cooler in which hot gas flows inside a plurality of spaced tubes could be used. In a fire-tube cooler, the space between the tubes is used as a conduit for a heat transfer medium to extract heat from the gases.

As the gas in the gas cooler 14 is cooled, tar-like substances condense or turn sticky and, therefore, tend to accumulate on the surfaces of the cooler. According to the present invention, the surfaces are kept clean, or cleaned after accumulation of deposits, by introducing solid particles into the gas flow in, or just before, the cooler 14. This, for example, may be accomplished by injecting coarse particles using by-pass conduit 40, the coarse particles being provided from particles being separated from the gas in the cyclone separator 26. Such particles include e.g., sand, additives and/or un-reacted fuel.

While injection can take place continuously, it is preferred that it be at spaced time intervals, for example, either intermittently or periodically, when it is expected that the layer of condensed and/or sticky material has deposited on clean surfaces. Alternatively, control may be automatic, e.g., in response to sensing of a decrease in cooling efficiency as a result of depositing or condensing of sticky substances.

A second cyclone separator 100 may be provided downstream of the gas cooler 14. The second separator may operate continuously, but is particularly necessary when particles are introduced (e.g., through by-pass conduit 40) to effect cleaning. Particles separated by the second separator may either be returned to the reactor chamber 18 or may be disposed of. The thus cleaned product gas, discharged from the second separator through gas dischage 27, may be filtered, and acted upon, or may be used directly, depending upon the desired use and the gas's composition.

In the FIG. 1 embodiment, the by-pass conduit 40 is controlled by a cover plate 42 being able to partly or wholly cover the inlet 44 into the by-pass conduit 40. The cover plate may be operated by a handle 46 by hand from outside the cyclone enclosure 48, or the cover plate 42 may be automatically operated by suitable automatic control means 50, such as a conventional computer controller, for controlling the flow of particles introduced for cleaning.

Typically, during a normal operation, only a very limited amount of solid particles, if any, flows from the particle separator 26 through the by-pass conduit 40 into the gas cooler, the cover plate 42 covering the inlet 44. At intervals, the cover plate 42 is pulled away to allow a sufficient amount of particles, to effect cleaning of the cooler surfaces by mechanically dislodging deposits therefrom, to pass the by-pass conduit 40.

Figure 2:
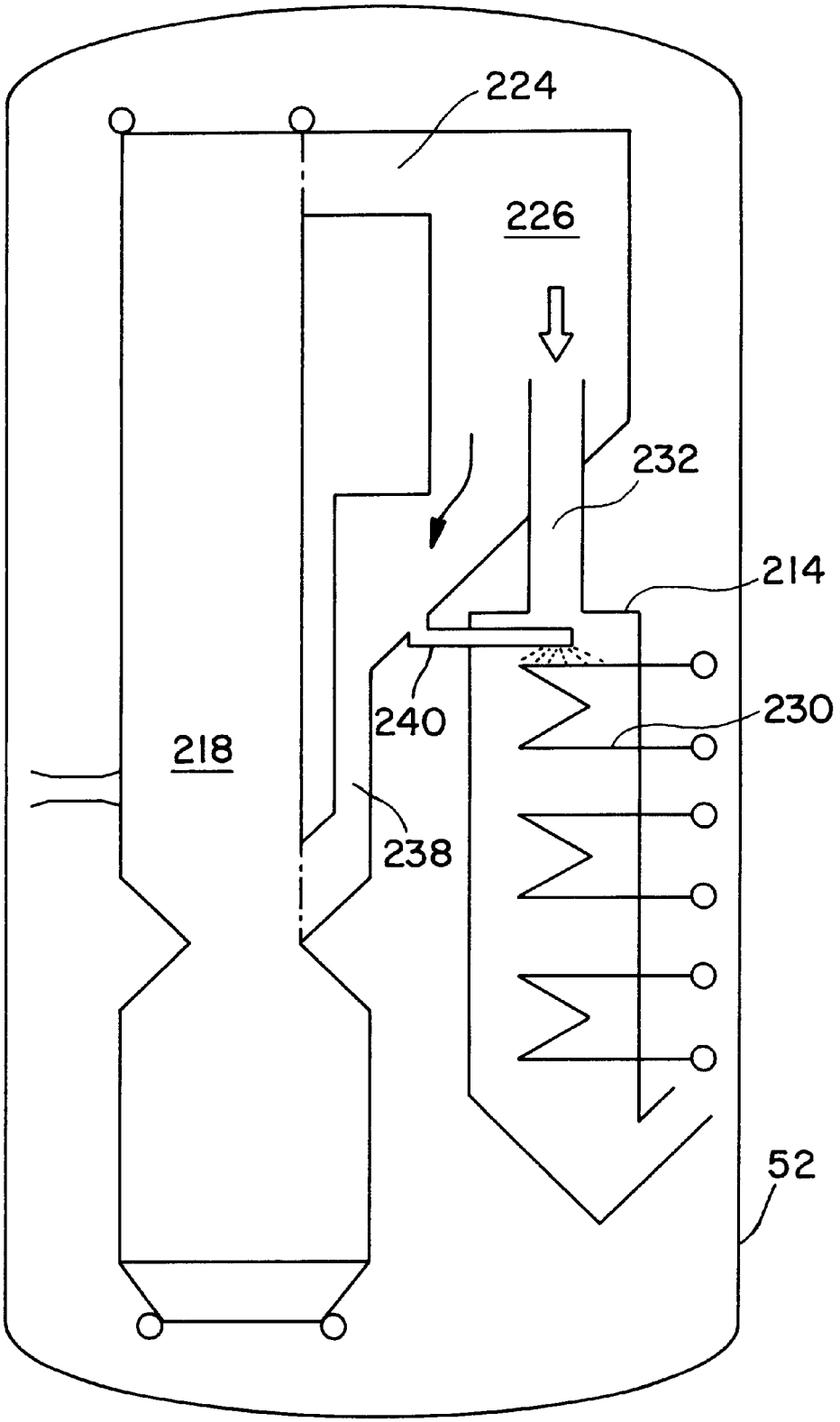
FIG. 2 is a schematic view of the second exemplary embodiment of a circulating fluidized bed reactor system according to the present invention.

FIG. 2 illustrates a system substantially the same as that shown in FIG. 1, in which the same reference numbers as those in FIG. 1 are used, preceded by a "2". In the FIG. 2 embodiment, the by-pass conduit 240 is connected to the return conduit 238 and solid particles are introduced directly into the gas cooler 214, not into the gas discharge conduit (or center pipe) 232. Several heat exchanger packages 230 are provided in the gas cooler. Fluidizing gas may be used to transport particles in the by-pass conduit 240. The reactor 218, cyclone 226 and gas cooler 214 are enclosed in a pressure vessel 52 for maintaining them at superatmospheric pressure.

Figure 3:
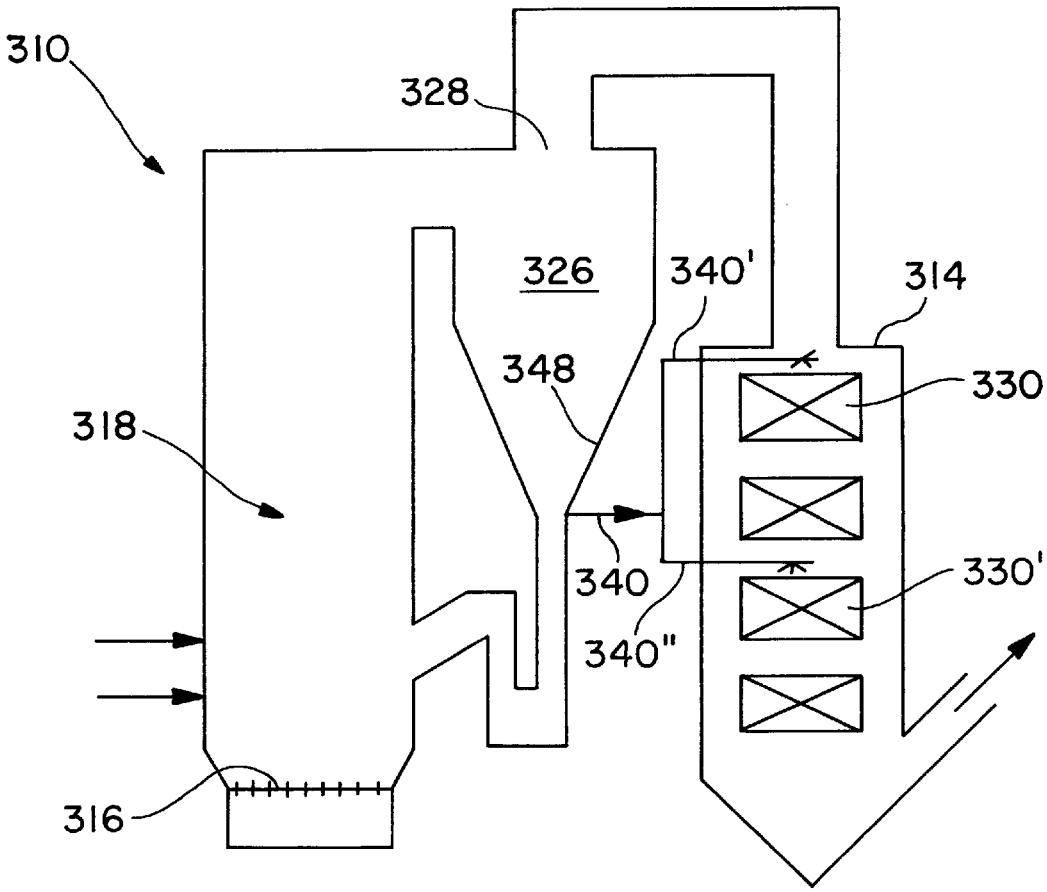
FIG. 3 is a schematic view of the third exemplary embodiment of a circulating fluidized bed reactor system according to the present invention.

FIG. 3 illustrates a further system substantially the same as that shown in FIGS. 1 and 2, in which the same reference numbers are used, preceded by a "3". The particle separator is a conventional cyclone 326 having its gas outlet 328 in the upper part thereof. Solid particles are gathered from the wall 348 of the cyclone and led through a by-pass conduit 340 into the gas cooler 314. The by-pass conduit 340 is divided into two conduits 340' and 340" introducing solid particles at different vertical levels in the gas cooler 314 to mainly effect cleaning of different heat exchanger packages 330 and 330'.

While the invention has been described above with respect to the use of a conventional generally circular configuration cyclone separator, it is to be understood that other cyclone separators can also be utilized, such as the type shown in U.S. Pat. No. 5,281,398. Also, other types of separators besides cyclone separators may be utilized.

Also, while the invention has been described particularly with reference to circulating fluidized beds, which are the preferred embodiments, under some circumstances, bubbling beds may be utilized instead.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of operating a fluidized bed reactor system for reacting fuel, the reactor system comprising (i) a fluidized bed reactor chamber having a reactor chamber outlet for gas produced during fuel reaction, (ii) a particle separator connected to the reactor chamber outlet for separating solid material from gas exhausted from the reactor chamber, the particle separator having a solid particle outlet and a gas outlet, and (iii) a gas cooler having cooling surfaces and being connected to the gas outlet of the particle separator, the method comprising the steps of:

(a) introducing solid material particles, fluidization medium and fuel into the reactor chamber to provide a fluidized bed therewithin;

(b) reacting the fuel material within the fluidized bed to produce exhaust gas and discharging the exhaust gas from the reactor chamber outlet;

(c) introducing the exhaust gas into the particle separator and separating solid particles from the gas in the particle separator;

(d) discharging from the particle separator (i) gas through the gas outlet and (ii) a first flow of separated solid particles through the solid particle outlet;

(e) cooling, in the gas cooler, the gas discharged from the separator;

(f) branching off, from the first flow of solid particles, before or after discharging the first flow of solid particles from the particle separator, a second flow of solid particles; and (g) introducing the second flow of solid particles into the gas discharged from the separator upstream of the gas being cooled in said cooling step, so that the solid particles mechanically dislodge deposits from, and thereby clean, the cooling surfaces in the gas cooler.

2. A method as recited in claim 1, further comprising (h) removing the particles from the gas after step (g).

3. A method as recited in claim 1, further comprising practicing steps (f) and (g) at spaced time intervals.

4. A method as recited in claim 1, further comprising practicing steps (f) and (g) continuously.

5. A method as recited in claim 1, wherein step (g) further comprises introducing the solid particles into the gas just before the gas cooler.

6. A method as recited in claim 1, wherein step (g) further comprises introducing the solid particles into the gas in the gas cooler.

7. A method as recited in claim 1, wherein the reactor is a circulating fluidized bed reactor, having a return conduit between the particle separator and the lower part of the reactor chamber, which return conduit receives all particles separated in the particle separator, and further comprising practicing steps (f) and (g) so as to periodically introduce a portion of the solid particles separated in the particle separator into the gas cooler.

8. A method as recited in claim 7, further comprising providing an inlet to a by-pass conduit connecting the particle separator with the gas cooler.

9. A method as recited in claim 8, further comprising periodically opening the inlet to the by-pass conduit to allow separated particles to flow through the by-pass conduit into the gas cooler.

10. A method as recited in claim 1, further comprising practicing steps (a)–(g) at superatmospheric pressure.

11. A method as recited in claim 10, wherein the superatmospheric pressure is between about two to about fifty bar.

12. A method as recited in claim 1, further comprising practicing step (b) so as to produce a gas at a temperature above 600° C.

13. A method as recited in claim 12, further comprising practicing step (e) so as to cool the gas to about 400° C.

14. A circulating fluidized bed the reactor chamber reactor system comprising:

a fluidized bed reactor chamber for reacting fuel, the reactor chamber having a fuel inlet, a bed material inlet, an exhaust gas outlet and a fluidizing gas inlet;

a cyclone separator connected to the exhaust gas outlet for separating solid bed material from the exhaust gas, the separator having (i) a gas outlet for discharging gas and (ii) a particle outlet for returning separated solid bed material to the reactor chamber;

a return conduit connecting the particle outlet of the separator to the reactor chamber for returning the separated solid material to the reactor chamber;

a gas cooler connected to the separator gas outlet for receiving the gas discharged from the separator, the gas cooler having cooling surfaces for cooling gas flowing therethrough; and means for branching off a flow of solid bed material from the solid bed material separated in the separator and for introducing the branched off flow of solid bed material into the gas discharged from the separator upstream of the gas being cooled in the gas coolers, so that the flow of solid bed material mechanically dislodges deposits from, and thereby cleans, the cooling surfaces in the gas cooler.

15. A reactor system according to claim 14, further comprising a pressure vessel, surrounding the reactor, the cyclone and the gas cooler, for maintaining those elements at superatmospheric pressure.

16. A reactor system according to claim 15, wherein the superatmospheric pressure is between about two to about fifty bar.

17. A reactor system according to claim 14, wherein the means for branching off a flow of solid bed material comprises, in the bottom of the cyclone separator, an opening connected to a by-pass conduit for leading separated solid bed material from the cyclone separator to the gas cooler.

18. A reactor system according to claim 17, wherein the means for branching off a flow of solid bed material further comprises a cover plate for covering the opening in the bottom of the separator.

19. A reactor system according to claim 14, wherein the means for branching off a flow of solid bed material comprises a by-pass conduit connecting the return conduit with the gas cooler.

20. A reactor system according to claim 14, wherein the cyclone separator comprises a vertical vortex chamber and a gas discharge conduit connected to the bottom of the cyclone.

21. A reactor system according to claim 14, wherein the cyclone separator comprises a vertical vortex chamber and a gas outlet connected to its upper part.

* * * * *